United States Patent [19]

Fox

[11] Patent Number: 4,523,678

[45] Date of Patent: Jun. 18, 1985

[54] EXTERNAL COAT POCKET FOR LUGGAGE

[76] Inventor: Paul W. Fox, 8611 Belcrest, St. John, Mo. 63114

[21] Appl. No.: 215,012

[22] Filed: Dec. 10, 1980

[51] Int. Cl.[3] ..... A45C 3/00; A45C 13/04

[52] U.S. Cl. ..... 206/287.1; 190/102; 190/111

[58] Field of Search ..... 190/41 A, 41 B, 41 Z, 190/43, 49, 52, 60, 100, 102, 109, 111, 119, 127; 150/1; 206/284, 287, 289, 287.1

[56] References Cited

U.S. PATENT DOCUMENTS

| | | | |
|---|---|---|---|
| 2,066,828 | 1/1937 | Cristina | 190/41 Z |
| 2,087,211 | 7/1937 | Marbury et al. | 190/43 |
| 3,115,959 | 12/1963 | Jaffe | 190/43 |
| 3,612,232 | 10/1971 | Larson | 190/49 |
| 3,826,296 | 7/1974 | Morris | 150/1 |
| 3,933,229 | 1/1976 | Pelavin | 190/41 B |

FOREIGN PATENT DOCUMENTS

| | | | |
|---|---|---|---|
| 2019823 | 9/1971 | Fed. Rep. of Germany | 190/43 |

*Primary Examiner*—William Price
*Assistant Examiner*—Sue A. Weaver
*Attorney, Agent, or Firm*—Polster, Polster and Lucchesi

[57] ABSTRACT

A folding bag having an outer side enclosure and having a length dimension larger in its unfolded condition than in its folded condition is provided with a pocket extending substantially the length of the bag. The pocket includes extender devices along the junction of the pocket with the outer side of the bag. In the preferred embodiment, hook means are provided to permit insertion and carrying of an outer garment, in the form of a top coat, for example, in the pocket.

10 Claims, 7 Drawing Figures

EXTERNAL COAT POCKET FOR LUGGAGE

BACKGROUND OF THE INVENTION

This invention relates to folding bags, and in particular, to hand carried luggage for personal use. While the invention is described in conjunction with such use, those skilled in the art will recognize the wider applicability and inventive principles as disclosed hereinafter.

Small, light-weight, folding bags have become increasingly popular for luggage, particularly for businessmen required to take relatively short trips. Such bags generally have a frame enclosed by a suitable material, the material having an outer surface. These folding bags, in their unfolded state, are substantially rectangular in plan, and have a depth dimension which receives the clothing of the user. Often the bags also include additional smaller pockets for carrying toilet articles, shoes or other articles of wear. Folding bags are popular because they may be hand carried on aircraft, for example, and stored either in hanging compartments or in overhead luggage racks, thereby eliminating the necessity of baggage check-in and reclaiming.

As will be appreciated, because of today's high speed transportation forms, business travelers often travel from one climate to another or to similar climates where overcoat or raincoat use is desirable. Business travelers often check luggage at hotels with bell captain personnel, for example, during period before check in or after check out, while the traveler is engaged in some other activity. The hotels watch the luggage until the traveler leaves for th next destination. Such luggage checking arrangements conventionally are not equipped to watch overcoats or the like. Prior to my invention, no convenient way for checking a raincoat or overcoat has been available.

My invention overcomes these prior art difficulties by providing a elongated outer or external pocket on a folding bag, for example, which is adapted to receive and permits hanging of an overcoat or raincoat. Even with insertion, the bag may be used in its normal manner, and checked or otherwise carried by a traveler. The pocket provides a secure, safe, yet accessible holder for the coat.

Those skilled in the art will recognize, of course, that various luggage bags, and folding bigger bags in particular, have employed external pockets in the past. To my knowledge, such external bag pockets were not adapted to the purpose for which my invention finds application; were not compatible with a wide range of hand carried luggage; and were not constructed in the manner in which the external pocket of this invention is manufactured.

One of the objects of this invention is to provide a folding bag in which an external coat retaining pocket is provided.

Another object of this invention is to provide a coat retaining pocket for luggage which is compatible with a number of luggage embodiments.

Another object of this invention is to provide a pocket for luggage in which expander devices are employed to permit the bag to fold, if desired.

Another object of this invention is to provide a external pocket in lugagge for reception of an overcoat, for example, the luggage structure including hook means for attaching the overcoat within the pocket.

Other objects of this invention will be apparent to those skilled in the art in light of the following description and accompanying drawings.

SUMMARY OF THE INVENTION

In accordance with this invention, generally stated, a hand carried luggage means is provided with an externally arranged, preferably expandable pocket receptable arranged to give access to the pocket interior without requiring access to the interior parts of the luggage. In the preferred embodiment, the folding bag has an outer side enclosure having a length dimension larger in its unfolded state than in its folded state. The external pocket is arranged to extend substantially the entire length of the bag. The pocket includes extender devices along the juncture between the pocket and the outer side of the bag to permit folding of the bag without constriction. Suitable closure devices are provided to restrict access to the external pocket.

DESCRIPTION OF THE PREFERRED EMBODIMENT

Figure 1:
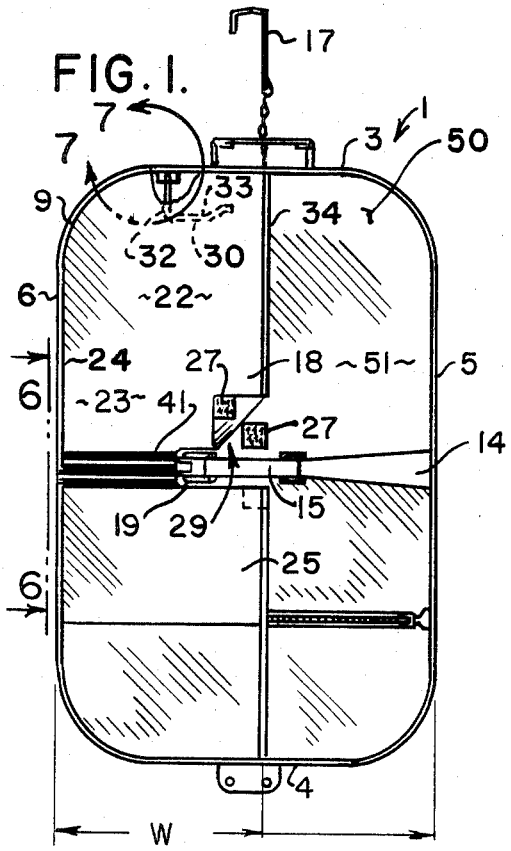
FIG. 1 is a top plan view of one illustrative embodiment of folding bag employing an external pocket of this invention.
Figure 4:
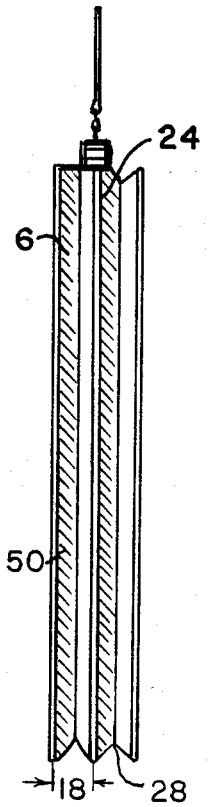
FIG. 4 is a view in side elevation of the bag shown in FIGS. 1 and 2.

Referring now to FIG. 1, reference numeral 1 indicates a folding bag generally having conventional design, but modified to include one illustrative embodiment of external pocket 22 of this invention. The bag 1 includes a frame 2, conventionally positioned at least along an upper end 3 of the bag 1, upper being referenced to FIG. 1. The frame 2 provides support and attachment for a cover 50 which generally defines, with the other conventional components of the bag 1, the end 3, and end 4, a side 5, a side 6, an outside face 51, and an inside face 7. The bag itself further has a depth 8, best shown in FIG. 4. The cover 50 conventionally delimits the outside face 51 of the bag, while the inside face 7 defines the inner side of the bag, inner, inside, and outside being referenced to the folded condition of the bag 1, not shown, where the face 7 is folded against itself.

Figure 3:
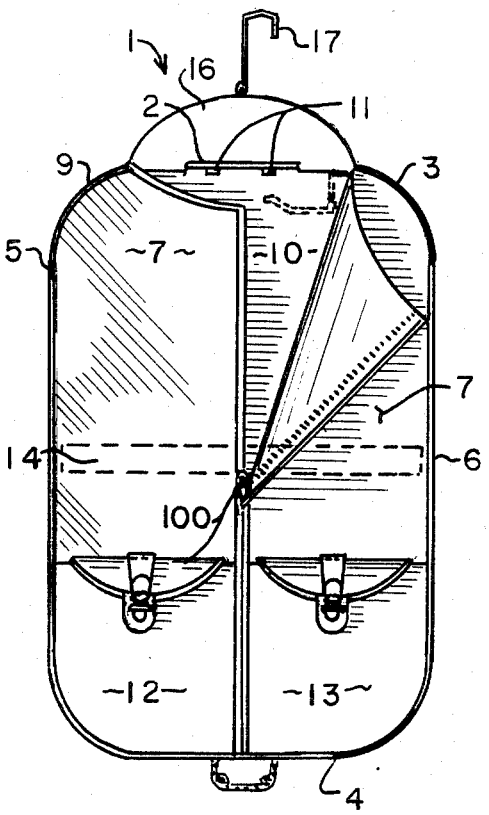
FIG. 3 is an opposite side plan view of the bag shown in FIGS. 1 and 2.
Figure 5:
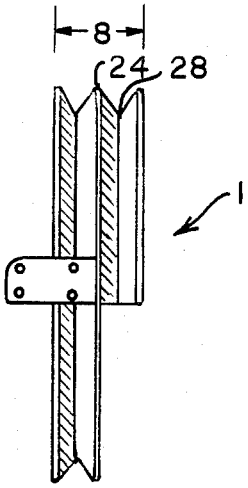
FIG. 5 is a bottom view of the bag shown in FIGS. 1 and 3.

As shown in FIG. 3, the inside face 7 generally is attached along its edges 9 to the sides 5 and 6 and ends 3 and 4. Conventionally, the inside face 7 is separable by a suitable closure means which, in the embodiment illustrated, is a conventional slide fastener 100. The slide fastener 100 permits access to a chamber 10 in which articles of clothing may be inserted. Commonly, there are suitable attachment means 11 provided for attaching hangers or the like within the chamber 10 of the bag 1. It also is conventional to provide pockets 12 and 13 for carrying various other articles. The bag 1 is foldable along a mid-section 14 and conventionally is provided with a handle 15 for carrying the bag 1.

Various constructional variations may be employed in embodiments of the bag 1. For example, sometimes a flap 16 is provided along the end 3 of the bag 1, the flap 16 permitting quick access to the chamber 10. Likewise, it has been conventional to provide a hook 17 along the end 3 of the bag, for example, by which the entire bag 1 is suspended on a hanger rod or the like. This is a particularly advantageous feature when the bag 1 is used during aircraft travel.

As shown, the bag 1 has a length dimension 20 in its unfolded condition which is substantially greater than a length dimension 21 of the bag when it is in its folded condition. As thus described, the bag 1 in itself is conventional and forms no part of my invention.

To the conventional bag 1 I have provided the coat accepting pocket 22, which extends for substantially the entire length dimension 20 of the bag 1. The pocket 22 is constructed from a cover piece 23 which is joined to the side 6 along a seam 24. Attachment may be made in any conventional manner. Preferably, the cover piece 23 is sized to cover approximately half of a width dimension W of the bag 1. The cover piece 23 is separably sectioned into a first part and a second part 25 near the centerline 14. The separable nature of the parts 25 and 26 may be accomplished by any number of ways. In the embodiment illustrated, conventional "Velcro" fasteners 27 are utilized. Other disengageable fasteners may be employed, if desired.

The connection of the cover piece 23 along the seam 24 is accomplished so that the cover piece 23 has an expansion area 28 associated with it. Expansion areas may be formed by allowing excess material of the cover piece 23 to be gathered together sufficiently to provide the necessary expansion area. The cover piece 23 defines a chamber part 29 with the outside face 51 after attachment along seam 24. The expansion area 28 permits expansion of the chamber part 29, giving easy access to the chamber part 29. The expansion device further permits the bag 1 to fold without difficulty, even when the chamber part 29 contains a coat or like outer garment. In order to accommodate outer garments within the chamber part 29, I provide a hook 30 which is attached to the frame 2 in any convenient way. Hook 30 extends through an opening 31 in the cover 50. The hook 30 preferably has a right angle bend 32 formed in it so that an end 33 points toward an edge 34 of the cover piece 23, allowing easy attachment of a coat or other outer garment within the chamber part 29.

Figure 2:
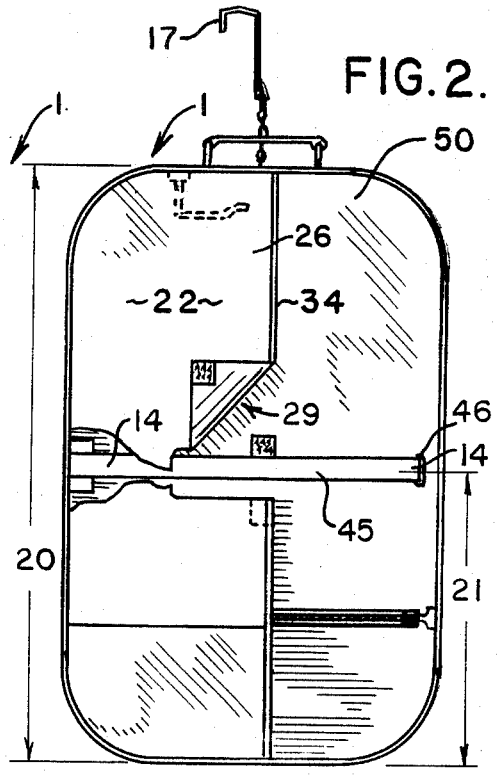
FIG. 2 is a plan view of a second illustrative embodiment of folding bag of this invention.
Figure 6:
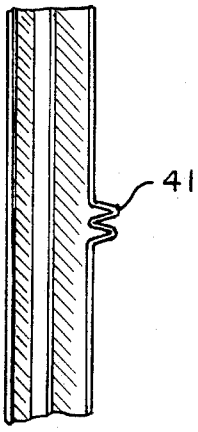
FIG. 6 is a view in side elevation, partly broken away, taken along the line 6—6 of FIG. 1.
Figure 7:
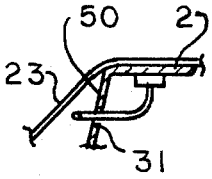
FIG. 7 is a sectional view, partly broken away, taken about the area 7—7 of FIG. 1.

As will be appreciated by those skilled in the art, adoption of the pocket 29 to a variety of bag 1 constructions is accomplished easily. For example, FIG. 1 illustrates the design in which the handle 15 is positioned along the centerline 14 of the bag. In this embodiment of the invention, a plurality of gussetts 41, as best seen in FIG. 6, are taken in the cover piece 23 to provide a second expansion means in the cover piece 23 construction, again simplifying folding of the bag 1. As shown in FIG. 1, the cover parts 25 and 26 merely are separated to permit the handle to extend through a gap 29 thereby defined. In FIG. 2, the bag 1 construction includes a strap 45 which extends along a substantial portion of the width W of the bag 1. With this form of bag 1 construction, a side opening 46 may be provided to permit passage of the strap 45 externally of the chamber part 29.

Use of the pocket 29 is both easy and convenient. The fasteners 27 are disengaged to gain access to the chamber part 29. The user's coat is then attached to the hook 30, and the chamber part 29 is reclosed. The coat and bag then can be hung or checked in any convenient location.

Numerous variations, within the scope of the appended claims, will be apparent to those skilled in the art in light of the foregoing description and accompanying drawings. Thus, the location and connection method of the hook 30 may be varied in other embodiments of this invention. As indicated, other fasteners 27 may be employed in conjunction with my invention. While the various expansion means are shown and described as a "gussett", other expansion constructions are compatible with the broader concept of this invention. For example, various elastic materials may be employed, if desired. Various constructional features indicated as preferred may be altered in other embodiments of the invention disclosed, if desired. These variations are merely illustrative.

Having thus described the invention, what is claimed and desired to be secured by Letters Patent is:

1. In a folding bag having a frame, and an enclosure supported by said frame, said enclosure including an inner side and an outer side, said enclosure defining a first article receiving area along the inner side thereof, said first article receiving means having attachment means therein, said bag having a length dimension longer in its unfolded condition than in its folded condition and greater than a width dimension of the bag, the improvement comprising an external coat accepting pocket along the outer side of said enclosure extending substantially the length of the bag, said coat accepting pocket including a cover piece interconnected with said bag so as to provide at least first expansion means at the juncture of said pocket with the outer side of said bag, said expansion means adapted to permit folding of said bag, and hook means mounted to said frame and having a portion extending through the outer side of said enclosure and positioned within said pocket for receiving garments, said coat accepting pocket being accessible by a user for insertion of articles therein in either the folded or unfolded condition of said bag.

2. The improvement of claim 1 further including means for closing said pocket along at least one edge of said pocket.

3. The improvement of claim 2 wherein said closure means comprises a slide fastener.

4. The improvement of claim 2 wherein said closure means comprises at least one snap.

5. The improvement of claim 2 wherein said closure means comprises Velcro fasteners.

6. The improvement of claim 2 further including means for passing a handle device for said bag through at least a portion of said pocket.

7. The improvement of claim 6 wherein said pocket substantially encloses half of the outside of said bag.

8. The improvement of claim 7 wherein said hook means includes a base having a hook-shaped appendage mounted to it, said base being offset with respect to said hook to permit attachment of said base to the frame of said bag.

9. In a garment bag having a frame, a cover over said frame, said cover having a first side and a second side, a length dimension and width dimension, said cover defining an article receiving area along one of said first and second sides, the improvement comprising a coat accepting pocket along the other one of said first and second sides, said coat accepting pocket extending the length dimension of said bag and accessible in either a folded or unfolded condition of said bag for insertion of articles therein, said pocket including first expansion means along the juncture of said pocket outside of said cover, second expansion means along the width dimension of said bag, and means positioned within said pocket but attached to said frame and extending through said cover, adapted to receive a portion of an article of apparel.

10. The improvement of claim 9 wherein said pocket including a cover piece having at least two edges, said cover piece being secured to said bag on one of said edges and being disengagably fastened to said bag along the other of said edges.

* * * * *